US008117787B2

(12) United States Patent
Lee

(10) Patent No.: US 8,117,787 B2
(45) Date of Patent: Feb. 21, 2012

(54) CONSTRUCTION SUPPORT

(76) Inventor: Sei-Won Lee, Seongnam-si (KR)

( * ) Notice: Subject to any disclaimer, the term of this patent is extended or adjusted under 35 U.S.C. 154(b) by 234 days.

(21) Appl. No.: 12/458,010

(22) Filed: Jun. 29, 2009

(65) Prior Publication Data

US 2010/0037537 A1 Feb. 18, 2010

(30) Foreign Application Priority Data

Aug. 15, 2008 (CN) ..... 2008 2 0132206 U

(51) Int. Cl.
*E04B 9/20* (2006.01)

(52) U.S. Cl. ..... 52/127.2; 248/54.13; 403/109.5; 52/632; 405/272; 405/288

(58) Field of Classification Search ..... 52/127.2, 52/632, 298, 290, 294, 249, 248, 301; 249/210, 249/18; 403/109.5, 314, 374.3; 405/229, 405/230, 272, 288, 29; 248/200.1, 351, 354.1
See application file for complete search history.

(56) References Cited

U.S. PATENT DOCUMENTS

| | | | | |
|---|---|---|---|---|
| 3,201,076 | A * | 8/1965 | Deleuze | 248/151 |
| 3,991,964 | A * | 11/1976 | Christopher | 248/354.1 |
| 4,234,151 | A * | 11/1980 | John et al. | 254/98 |
| 4,277,197 | A * | 7/1981 | Bingham | 403/104 |
| 5,098,134 | A * | 3/1992 | Monckton | 285/38 |
| 6,467,741 | B1 * | 10/2002 | Shih | 248/200.1 |

FOREIGN PATENT DOCUMENTS

| | | |
|---|---|---|
| JP | 52-38912 | 3/1977 |
| JP | 08-144543 | 6/1996 |
| KR | 20-0257249 | 12/2001 |
| KR | 20-0393472 | 8/2005 |
| WO | WO 2006/126774 | 11/2006 |

* cited by examiner

*Primary Examiner* — Robert Canfield
*Assistant Examiner* — Jody Giacoman
(74) *Attorney, Agent, or Firm* — Harness, Dickey & Pierce, P.L.C.

(57) ABSTRACT

Provided is a construction support, a length of which can be precisely and easily adjusted to a floor-to-floor height between upper and lower floor slabs, capable of supporting the load of the upper floor slab in a more stable and firm manner and performing dismantlement in a more convenient manner. The construction support includes a first pipe, a second pipe, an inner stopper, an outer stopper, and an outer cap.

19 Claims, 8 Drawing Sheets

CONSTRUCTION SUPPORT

CROSS-REFERENCE TO RELATED APPLICATION

This application claims priority to and the benefit of Chinese Utility Model Application No. 200820132206.X, filed Aug. 15, 2008, the disclosure of which is incorporated herein by reference in its entirety.

BACKGROUND

1. Field

Example embodiments relate to a construction support and, more particularly, to a construction support, a length of which can be precisely and easily adjusted to a floor-to-floor height between upper and lower floor slabs, capable of supporting the load of the upper floor slab in a more stable and firm manner and performing dismantlement in a more convenient manner.

2. Discussion of Related Art

Such a construction support refers to a supporting post (known as a "dongbari" among those skilled in the art in Korea), and is a tool used to support the load of a slab in various buildings.

The slab generically refers to a flat concrete mat, and is typically called a floor slab. In ordinary reinforced concrete structures, the slab is surrounded by beams, and the load applied to the slab is distributed among the surrounding beams. Further, in the general case in which a span ranges from 4 m to 5 m, the slab would have a thickness of about 15 cm.

Among the slabs, a flat slab is a reinforced concrete slab directly carried on posts without being supported by beams or girders. The flat slab may be arranged by special reinforcing bars, particularly to such a degree that bending strength thereof is maintained at a safe level.

For example, as schematically illustrated in FIG. 1, many supports 1 are used to support a slab of a building until the slab is poured and then fully cured.

These supports have a variety of types from a primitive type such as a wooden support to a length-variable type, and various structures and mechanisms continue to be proposed. Despite being a simple tool, the support is essential to building or civil engineering sites, and is used in a large quantity. As such, the support occupies a part of construction cost, and is a factor that requires much manpower and time for installation and dismantlement.

FIG. 2 is an exploded perspective view of a conventional construction support. The conventional support 1 is constructed to connect a lower pipe 10 with an upper pipe 20 using a coupling member 30. The upper pipe 20 has a relatively smaller diameter than the lower pipe 10. Thus, the upper pipe 20 may be inserted into the lower pipe 10 to adjust a length of the support.

The conventional support 1 of FIG. 2 has multiple pairs of catch holes 21 spaced apart from each other at regular intervals in an outer circumference of the upper pipe 20 in order to fix the upper pipe 20.

Further, a pair of coupling holes 11 is formed through an outer circumference of one end of the lower pipe 10.

The coupling member 30 is inserted into the coupling holes 11.

The upper pipe 20 is inserted into the lower pipe 10, and then is pulled to come into contact with a slab. When the catch holes 21 of the upper pipe 20 are aligned with the coupling holes 11 of the lower pipe 10, the coupling member 30 is inserted into the coupling and catch holes 11 and 21 of the lower and upper pipes 10 and 20. Thereby, the upper pipe 20 is fixed.

Since this conventional support 1 is configured such that the upper pipe 20 is inserted into the lower pipe 10 and the coupling member 30 is inserted and fixed into the aligned coupling and catch holes 11 and 21, it is substantially difficult to precisely adjust an interval between the slab and the upper pipe 20. In order to solve this problem, if the interval between the catch holes 21 becomes narrow, the catch hole 21 of the upper pipe 20 has a chance of being damaged by the load of the slab which is applied to the upper pipe 20 in a downward direction. As such, this may compromise safety.

Further, since the coupling member 30 is fixed by the insertion whenever the support 1 is installed, the time required for the installation or dismantlement work increases, and thus the accompanied manpower also increases.

SUMMARY

An example embodiment is directed to provide a construction support, in which an interval between a bottom surface and a slab support surface can be precisely adjusted to support the load of the slab.

Another example embodiment is directed to provide a construction support, capable of increasing a supporting force against the load transmitted from a slab to support the load of the slab in a more stable and firm manner when installed.

Still another example embodiment is directed to provide a construction support, in which installation and dismantlement can be conveniently performed to reduce work time and accompanied manpower thereof.

In example embodiments, a length-adjustable construction support includes: a first pipe; a second pipe having an outer diameter smaller than an inner diameter of the first pipe; an inner stopper coupled to an outer circumference of the second pipe at a predetermined position, and having a plurality of pressure ridges formed on an inner circumference thereof to press and fix the outer circumference of the second pipe, a separation guide flange protruding outward from an outer circumference thereof by a predetermined length, and at least one cutout slot formed in a lengthwise direction thereof; and an outer stopper having a support wall formed on an inner circumference thereof such that the inner stopper is inserted and supported, and a stop step formed at a lower end of the support wall to be supported on the first pipe.

The inner stopper may include an inclined surface on an outer circumference thereof such that an outer diameter thereof is gradually reduced in an inserting direction thereof. The support wall of the outer stopper may be inclined corresponding to the inclined surface of the inner stopper.

The pressure ridges may be formed in the form of a sawtooth or ratchet.

The sawtooth or ratchet form may be inclined in a direction opposite to an inserting direction of the inner stopper.

The inner stopper may include a ring retaining groove formed in at least one of upper and lower ends thereof. The ring retaining groove may be fitted with a snap ring.

The support may further include an outer cap, an inner circumference of which has a diameter equal to a diameter of an upper outer circumference of the outer stopper to be coupled to the upper outer circumference of the outer stopper, and which has a through-hole in the center thereof to allow the inner stopper inserted into the outer stopper to be inserted.

The outer cap may include a threaded part formed on the inner circumference thereof, and the outer stopper may include a first threaded part formed on the upper outer circumference thereof, so that the outer cap is screwed with the outer stopper.

The outer cap may include at least one rotating handle formed on the outer circumference thereof at intervals of a predetermined angle.

The through-hole may have a diameter smaller than an outer diameter of the separate guide flange.

The outer stopper may include at least one keying groove formed in the inner circumference thereof, and the inner stopper may include at least one keying groove formed in the outer circumference thereof to correspond to the keying groove of the outer stopper. The keying grooves may be fitted with an anti-rotation key to prevent the inner stopper from rotating.

The anti-rotation key may be integrally formed with the keying groove of the outer stopper.

The inner stopper may include a retaining recess that is recessed inward under the separation guide flange with a predetermined width, so that the through-hole of the outer cap is located in the retaining recess to allow the outer cap to move in the retaining recess within the predetermined width.

The support may further include: a third threaded part formed on a lower outer circumference of the outer stopper; a precise adjustor having a fourth threaded part formed on an inner circumference thereof to be screwed with the third threaded part, a fifth threaded part formed below the fourth threaded part, and an adjusting knob formed on an outer circumference thereof; and a coupler having a sixth threaded part formed on an outer circumference thereof to be screwed with the fifth threaded part, and coupled to the outer circumference of the first pipe.

BRIEF DESCRIPTION OF THE DRAWINGS

The above and other objects, features and advantages of the present invention will become more apparent to those of ordinary skill in the art by describing in detail example embodiments thereof with reference to the attached drawings, in which.

DETAILED DESCRIPTION OF EXAMPLE EMBODIMENTS

Figure 1:
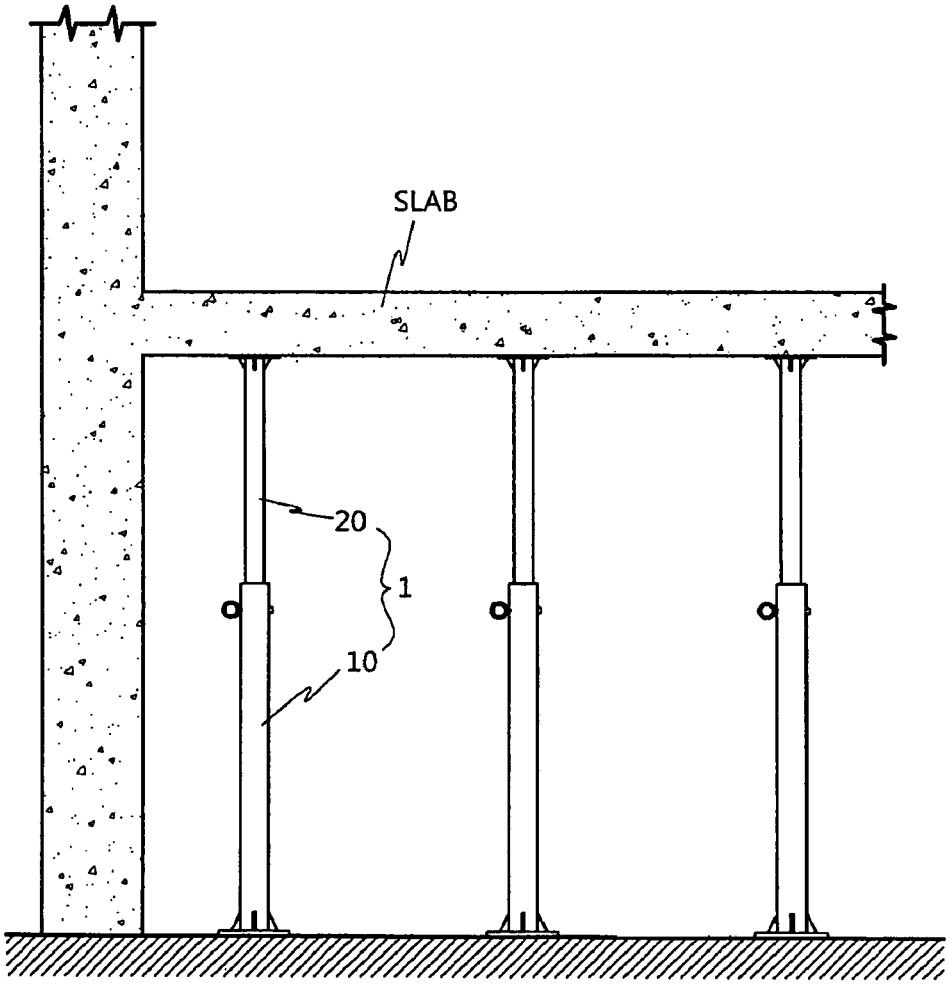
FIG. 1 CONVENTIONAL ART
FIG. 1 is an exploded perspective view of a conventional construction support.
Figure 2:
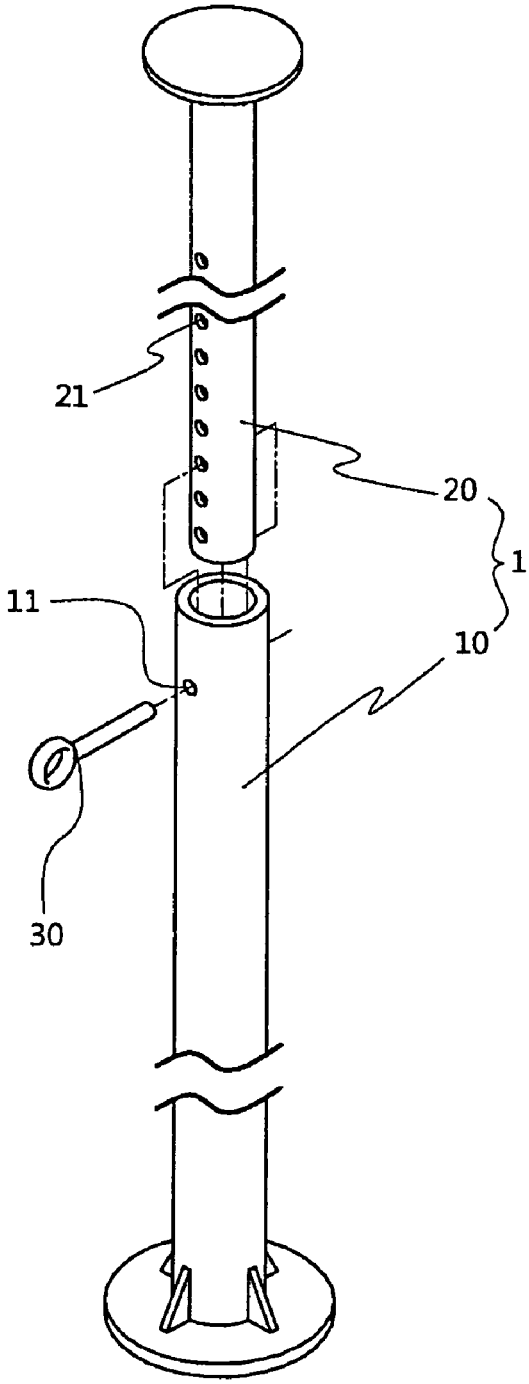
FIG. 2 CONVENTIONAL ART
FIG. 2 illustrates usage of the conventional construction support.

The invention will now be described more fully with reference to the accompanying drawings in which some example embodiments are shown. The invention, however, may be embodied in many alternate forms and should not be construed as limited to only example embodiments set forth herein. Accordingly, it should be understood that there is no intent to limit example embodiments to the particular forms disclosed, but on the contrary, example embodiments are to cover all modifications, equivalents, and alternatives falling within the scope of the invention. Like numerals, symbols or letters are used to designate like or equivalent elements having the same function throughout the description of the figures.

It will be understood that, when referred to as being "connected" or "coupled" to another element, an element may be directly connected or coupled to the other element or indirectly via an intervening element(s). In contrast, when an element is referred to as being "directly connected" or "directly coupled" to another element, there is no intervening element(s) present.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined herein, all the terms used herein including technical or scientific terms may have the same meaning as terms generally understood by those skilled in the art to which this invention belongs. It will be further understood that terms, such as those defined in commonly used dictionaries, should be interpreted as having the same meanings as those in the context of the related art. Unless expressly defined so herein, these terms are not interpreted as ideal or excessively formal meanings.

Hereinafter, example embodiments of the invention will be described in greater detail with reference to the accompanying drawings. In the following detailed description, the same reference numeral will be used for the same component or components regardless of the figures in order to facilitate understanding of the example embodiments of the invention.

Figure 3:
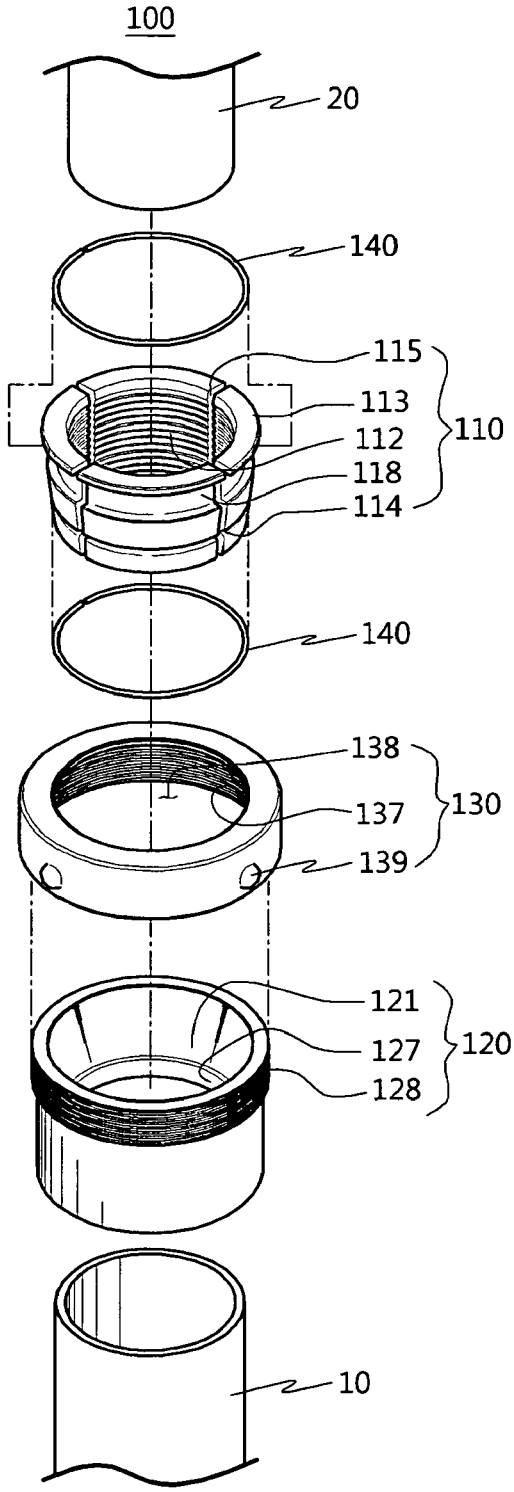
FIG. 3 is an exploded perspective view of a construction support according to an example embodiment of the present invention.
Figure 4:
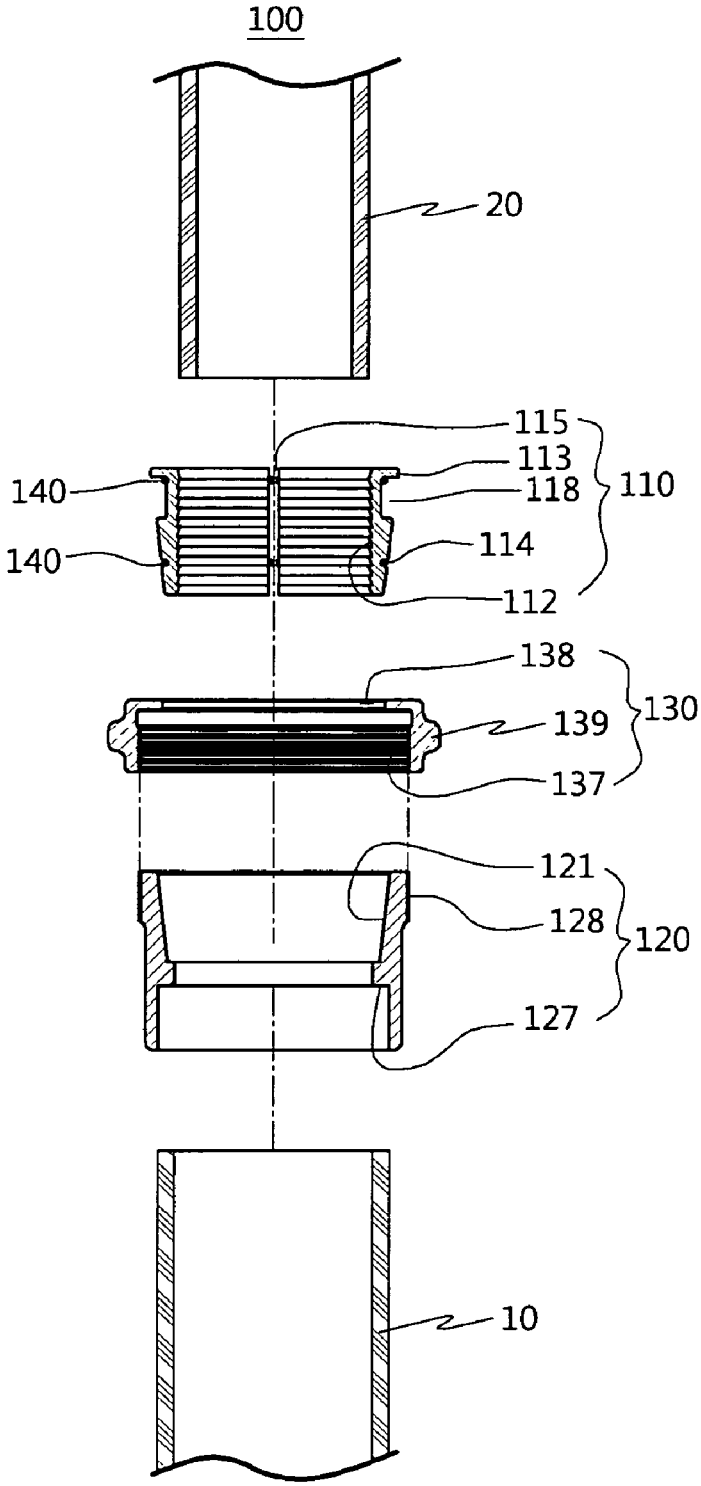
FIG. 4 is an exploded cross-sectional view of the construction support according to an example embodiment of the present invention.

FIG. 3 is an exploded perspective view of a construction support according to an example embodiment of the present invention. FIG. 4 is an exploded cross-sectional view of the construction support according to an example embodiment of the present invention.

Referring to FIG. 3, the construction support 100 includes a first pipe 10, a second pipe 20, an inner stopper 10, an outer stopper 120, and an outer cap 130.

The first pipe 10 has a hollow cylindrical shape and a predetermined length. The first pipe 10 is inserted into the outer stopper 120 at one side thereof, and is located on the ground on the other side thereof. Here, the first pipe 10 may generally be coupled with a jack or a support plate at a lower end thereof.

The second pipe 20 has a hollow cylindrical shape and a predetermined length. The second pipe 20 has a smaller outer diameter than an inner diameter of the first pipe 10. Here, the second pipe 20 may be coupled with a support plate at an upper end thereof to support a structure such as a foam for a slab.

Further, the second pipe 20 is located to support the load of the slab poured at one side thereof. Here, a supporting force is generated by pressurization of the inner stopper 110.

Steel pipes having enough strength to be used as a support member of the structure may generally be used for each of the first and second pipes 10 and 20, but the pipes are not limited to these materials. Further, there is no limitation on the diameters of the first and second pipes 10 and 20.

The inner stopper 110 includes pressure ridges 112, a separation guide flange 113, a cutout slot 115, and a ring retaining groove 114.

The inner stopper 110 is provided with an inclined surface 111, which is inclined at an outer circumference of the inner stopper 110 at a predetermined angle. Here, the inclined surface 111 is constructed so that an outer diameter of the inner stopper 110 is gradually reduced in an inserting direction thereof, i.e. toward a lower end thereof.

The pressure ridges 112 are formed on an entire inner circumference of the inner stopper 110 in a lengthwise direction. Preferably, each pressure ridge 112 may be formed in the form of a sawtooth or ratchet.

Each pressure ridge 112 has a predetermined angle of inclination in a direction opposite to that in which the inner stopper 110 is inserted.

Here, the ratchet refers to a device that allows linear or rotary motion in only one direction by action of a pawl, while preventing motion in the opposite direction.

Further, the pressure ridges 112 serve to press and fix an outer circumference of the second pipe 20 inserted into the inner stopper 110.

The separation guide flange 113 protrudes outward from an upper end of the inner stopper 110 by a predetermined length.

The cutout slot 115 is formed in a circumference of the inner stopper 110 in such a manner that the inner stopper 110 is cut out into inner sub-stoppers at intervals of a predetermined central angle. Thus, one or more cutout slots 115 are formed in the lengthwise direction of the inner stopper 110.

The cutout slots 115 may be selectively formed at intervals of 45, 90, 120, or 180 degrees, preferably 90 degrees.

The ring retaining groove 114 is formed in at least one of the upper and lower ends of the inner stopper 110, preferably adjacent to the separation guide flange 113 and spaced from the separate guide flange 113. Preferably, a snap ring 140 may be fitted into the ring retaining groove 114.

The ring retaining groove 114 and the snap ring 140 integrate the inner sub-stoppers divided from the inner stopper 110 by the cutout slots 115. The inner stopper 110 integrated by the snap ring 140 has a predetermined resilient force.

Further, when the inner stopper 110 is spread outward by the predetermined resilient force, and then the second pipe 20 is inserted into the inner stopper 110 to be surrounded by the pressure ridges 112, the pressure ridges 112 press the outer circumference of the second pipe 20 due to the snap ring 140. This pressing force is derived from a predetermined resilient force of the snap ring 140. Thus, this pressing force is weak, so that the inner stopper 110 can move to a predetermined position by itself or together with the second pipe 20.

The inner stopper 110, which moves to the predetermined position, is engaged with an inner circumference of the outer stopper 120. Further, the inner stopper 110 is provided with a retaining recess 118, which is recessed inward with a predetermined width under the separation guide flange 113.

The outer stopper 120 includes a support wall 121, a stop step 127, and a first threaded part 128.

The support wall 121 is formed on an inner circumference of the outer stopper 120. The support wall 121 is formed to correspond to the inclined surface 111 of the inner stopper 110, i.e. is constructed so that an inner diameter of the outer stopper 120 is gradually reduced in the inserting direction of the inner stopper 110 at a predetermined angle of inclination.

Here, by forming the support wall 121 to correspond to the inclined surface 111 of the inner stopper 110, the pressure ridges 112 are allowed to press and fix the outer circumference of the second pipe 20 with stronger force as the inner stopper 110 is pressed inward while being inserted into the upper portion of the outer stopper 120.

Further, an average inner diameter of the support wall 121 is equal or similar to an average outer diameter of the inclined surface 111 of the inner stopper 110.

The stop step 127 is formed at a lower end of the support wall 121 such that one end of the first pipe 10 inserted into the outer stopper 120 is caught.

Further, the stop step 127 also serves to regulate movement of the inner stopper 110 moving along the support wall 121 above. In detail, the stop step 127 restricts the movement of the inner stopper 110 moving along the support wall 121, so that a proper pressing force can be applied to the second pipe 20.

Meanwhile, the load of the slab is transmitted to the second pipe 20. Due to this load, the inner stopper 110 moves along the support wall 121, so that the pressing force of the pressure ridges 112 of the inner stopper 110 can increase. Thus, unless the outer stopper 120 has the stop step 127, the second pipe 20 may be damaged by the increased pressing force.

In addition, a lower portion of the outer stopper 120 having the stop step 127 has an inner diameter equal or similar to the outer diameter of the first pipe 10.

Here, the first pipe 10 may be forcibly fitted into the outer stopper 120.

The first threaded part 128 is formed on an upper outer circumference of the outer stopper 120. A thread form of the first threaded part 128 may be selectively applied.

The outer cap 130 is provided with a second threaded part 137 on an inner circumference thereof to be screwed with the first threaded part 128. As with the thread form of the first threaded part 128, a thread form of the second threaded part 137 may also be selectively applied.

Further, the outer cap 130 is provided with a through-hole 138 in the center thereof through which the inner stopper 110 can be inserted. An inner diameter of the through-hole 138 is smaller than an outer diameter of the separation guide flange 113.

In addition, the outer cap 130 is provided with at least one rotating handle 139, which protrudes from an outer circumference of the outer cap 130. Preferably, four rotating handles 139 are formed at intervals of 90 degrees.

The rotating handles 139 are used to rotate the outer cap 130.

When the outer cap 130 is rotated in the inserting direction of the inner stopper 110, the inner stopper 110 is further inserted into and fixed in the outer stopper 120 by a rotating force of the outer cap 130. In contrast, when the outer cap 130 is rotated in the opposite direction, the inner stopper 110 in close contact with the outer stopper 120 is easily separated from the outer stopper 120.

The snap ring 140 is partially cut out. The snap ring 140 is fitted into the ring retaining groove 114, and provides a predetermined resilient force to the inner stopper 110.

Figure 5:
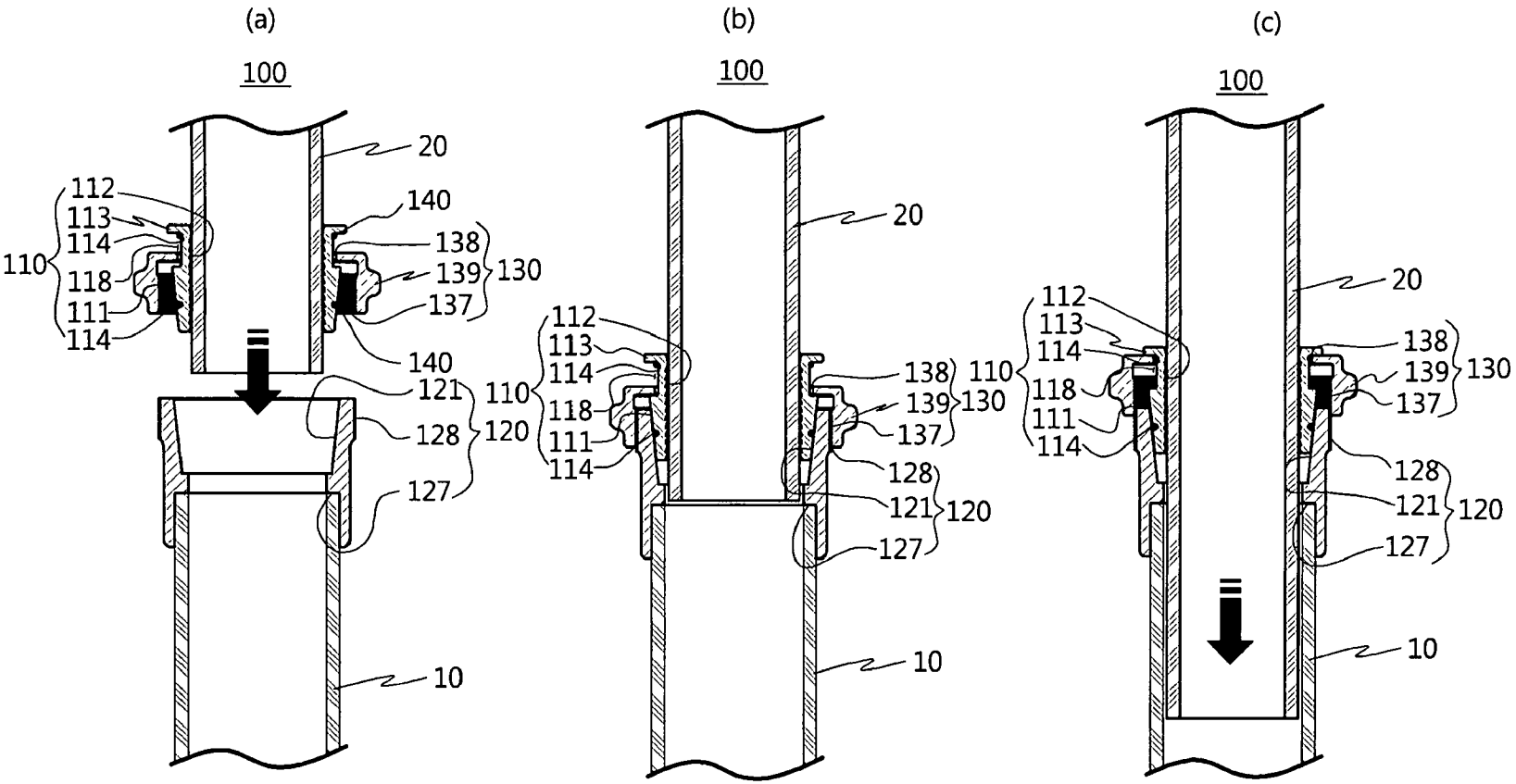
FIGS. 5(*a*), 5(*b*) and 5(*c*) are cross-sectional views for explaining installation and dismantlement of the construction support according to an example embodiment of the present invention.

FIGS. 5(*a*), 5(*b*) and 5(*c*) are cross-sectional views for explaining installation and dismantlement of the construction support according to an example embodiment of the present invention.

A description will be made regarding installation of the construction support with reference to FIGS. 5(*a*), 5(*b*) and 5(*c*).

The first pipe 10 is fitted into the lower portion of the outer stopper 120. Here, a lower inner circumference of the outer stopper 120 has a diameter equal or similar to the outer diameter of the first pipe 10 to be fitted. The first pipe 10 may be forcibly fitted into the outer stopper 120. Alternatively, the upper outer circumference of the first pipe 10 and the lower inner circumference of the outer stopper 120 may be threaded and screwed with each other.

The inner stopper 110 is inserted into the through-hole 138 of the outer cap 130. In this case, when the snap ring 140 is fitted into the ring retaining groove 114 of the inner stopper 110 that is divided by the cutout slots 115, the outer diameter of the inner stopper 110 is reduced, so that the inner stopper 110 can be easily inserted into the through-hole 138.

At this time, the through-hole 138 is located in the retaining recess 118 formed under the separation guide flange 113, and then the second pipe 20 is inserted into the inner stopper 110.

When the second pipe 20 is inserted into the inner stopper 110, the inner stopper 110 is spread by elasticity of the snap ring 140 according to the outer diameter of the second pipe 20.

Meanwhile, the second pipe 20 is pulled out to adjust a distance to correspond to the slab, and then the inner stopper 110 is inserted into the outer stopper 120.

At this time, as the inner stopper 110 moves into the outer stopper 120 by the inclined surface 111 of the inter stopper 110 and the support wall 121 of the outer stopper 120, the pressure ridges 112 of the inner stopper 110 firmly fix the second pipe 20 while pressing the outer circumference of the second pipe 20.

Thus, when the second pipe 20 is fixed, the outer cap 130 held in the retaining recess 118 is brought in the inserting direction of the inner stopper 110, and then is rotated and fastened using the rotating handle 139 formed on the outer cap 130 such that the first threaded part 128 formed on the outer circumference of the outer stopper 120 is screwed with the second threaded part 137 formed on the inner circumference of the outer cap 130. Thereby, the second pipe 20 may be prevented from being displaced by the load of the slab, and may provide a firm supporting force (see FIG. 5(*b*)).

Afterwards, when the slab is completely cured, the construction support 100 is dismantled. To this end, when rotated in the opposite direction, the outer cap 130 presses the separation guide flange 113 (see FIG. 5(*c*)).

Here, a pressing force of the separation guide flange 113 is generated by a rotating force of the outer cap 130, and the generated pressing force is transmitted to the inner stopper 110, so that the inner stopper 110 is pushed upward and is separated from the outer stopper 120. At this time, the pressure ridges 112 of the inner stopper 110 release the force applied to the second pipe 20. Thus, since only the elasticity of the snap ring 140 is provided to the second pipe 20, the second pipe 20 is pulled downward with weak force, and thus can be easily separated from the slab.

Figure 6:
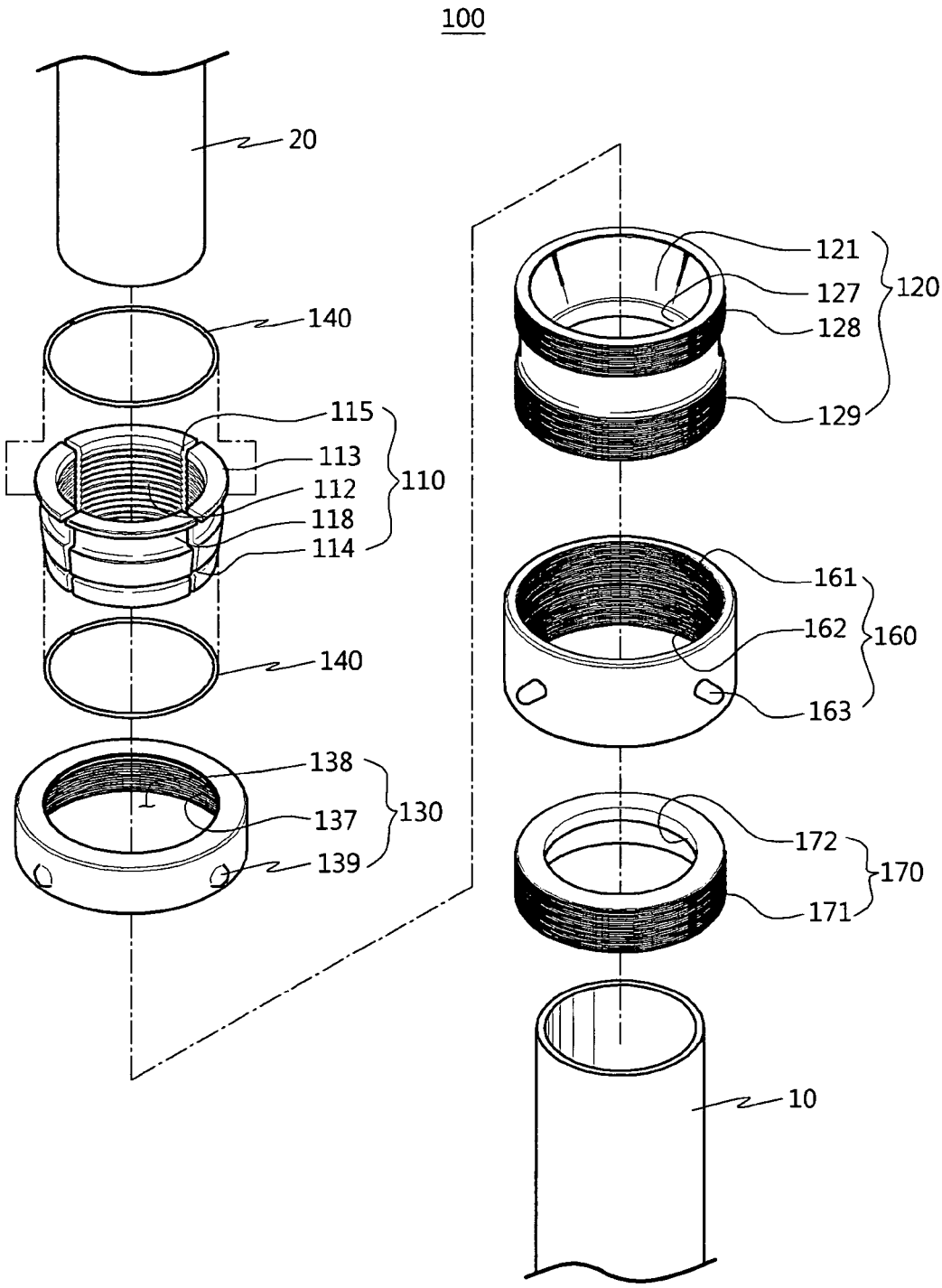
FIG. 6 is an exploded perspective view of a construction support according to another example embodiment of the present invention.

FIG. 6 is an exploded perspective view of a construction support according to another example embodiment of the present invention. The example embodiment of FIG. 6 is different from that of FIG. 1 in that a precise adjustor 160 and a coupler 170 are further provided between the outer stopper 120 and the first pipe 10. Thus, the example embodiment of FIG. 6 is configured so that the second pipe 20 can more precisely come into close contact with the slab by adjustment of the precise adjustor 160.

For the adjustment of the precise adjustor 160, a third threaded part 129 is formed on a lower outer circumference of the outer stopper 120.

Further, a fourth threaded part 161 is formed on an upper inner circumference of the precise adjustor 160 to be screwed with the third threaded part 129. A fifth threaded part 162 is formed on a lower inner circumference of the precise adjustor 160 below the fourth threaded part 161. Here, the fourth threaded part 161 has threads opposite to those of the fifth threaded part 162.

For example, if the fourth threaded part 161 has left-hand threads tightened by counterclockwise rotation, the fifth threaded part 162 has right-hand threads tightened by clockwise rotation. This configuration is designed to vary a length, because the fourth and fifth threaded parts 161 and 162 are tightened or loosened by rotation in opposite directions.

Further, the precise adjustor 160 is provided with at least one adjusting knob 163 on an outer circumference thereof. The adjusting knob 163 facilitates rotation of the precise adjustor 160, thereby allowing the second pipe 20 to be in close contact with the foam for the slab.

The coupler 170 is coupled to the upper outer circumference of the first pipe 10. The coupler 170 has an inner diameter equal or similar to the outer diameter of the first pipe 10. At this time, the coupler 170 may be coupled with the first pipe 10 by interference fit or fixing means such as welding.

Further, the coupler 170 is provided with a sixth threaded part 171 on an outer circumference thereof. The sixth threaded part 171 is screwed with the fifth threaded part 162. Thus, the sixth threaded part 171 has threads formed in a direction corresponding to threads of the fifth threaded part 162.

Further, the coupler 170 is provided with a stop rim 172 at an upper end thereof such that the upper end of the first pipe 10 inserted into the coupler 170 is caught.

Figure 7:
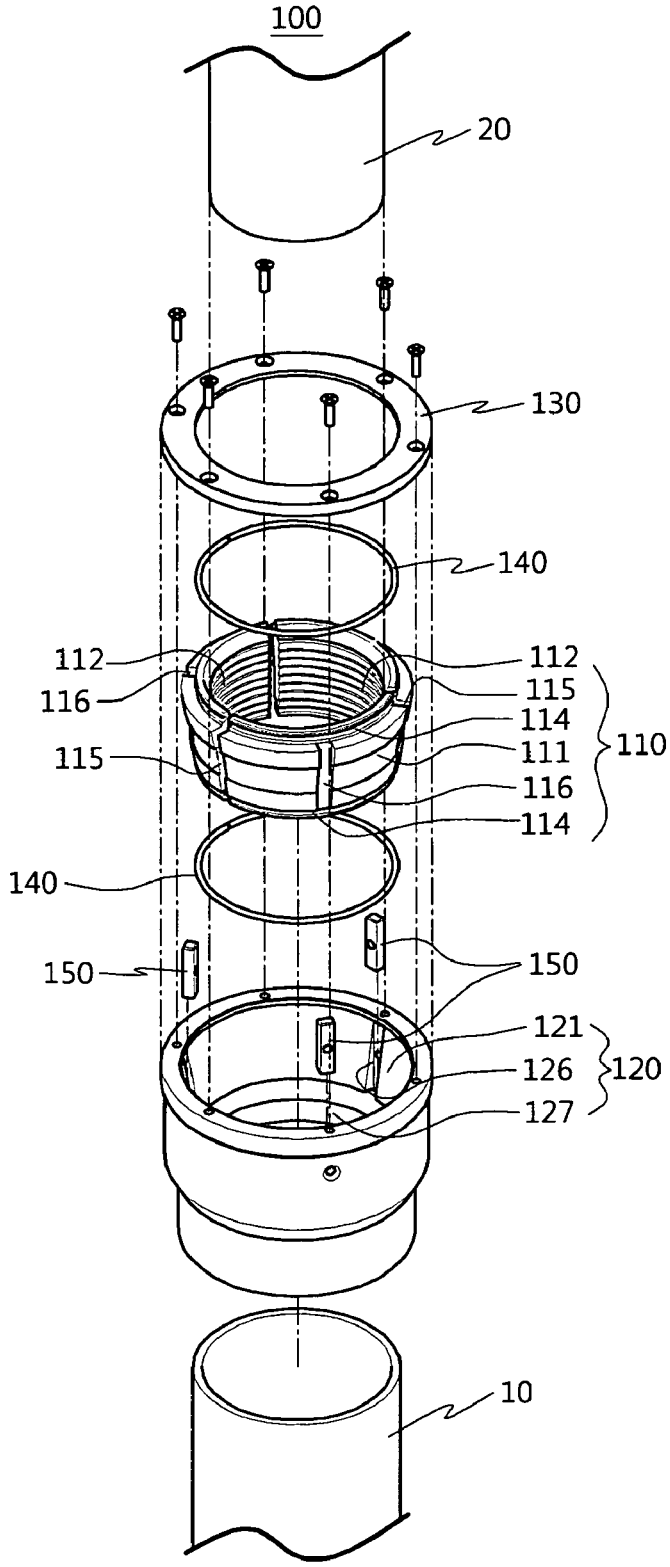
FIG. 7 is an exploded perspective view of a construction support according to still another example embodiment of the present invention.
Figure 8:
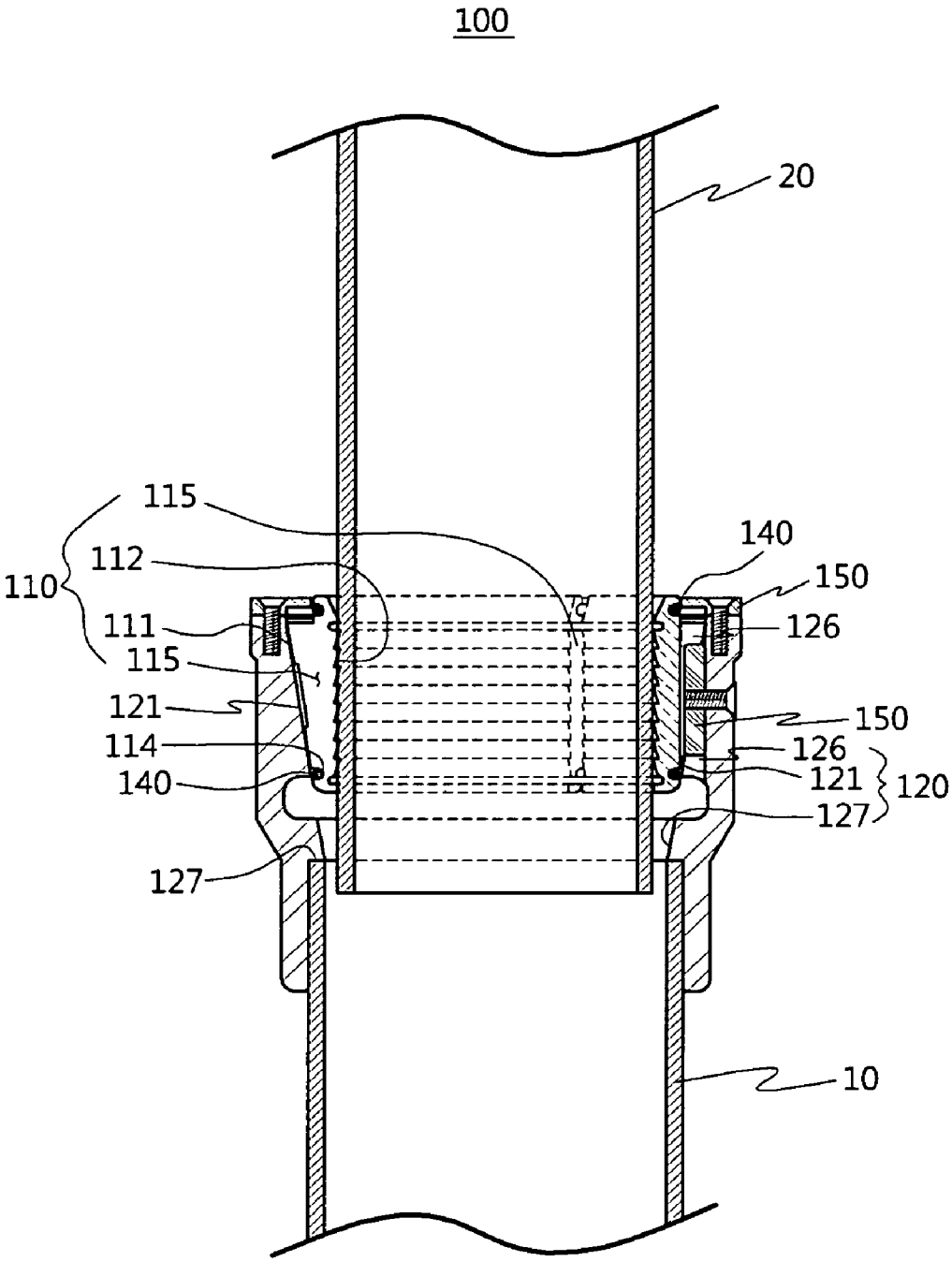
FIG. 8 is a cross-sectional view illustrating installation of the construction support of FIG. 7.

FIG. 7 is an exploded perspective view of a construction support according to still another example embodiment of the present invention. FIG. 8 is a cross-sectional view illustrating installation of the construction support of FIG. 7.

Referring to FIGS. 7 and 8, the construction support 100 includes a first pipe 10, a second pipe 20, an inner stopper 110, an outer stopper 120, and an outer cap 130.

The first and second pipes 10 and 20 have the same configuration as those described in FIG. 3, and thus a detailed description thereof will be omitted in order to avoid redundancy.

The inner stopper 110 is provided with a plurality of pressure ridges 112 on an inner circumference thereof.

Further, the inner stopper 110 is provided with at least one cutout slot 115 at a predetermined position. Further, the inner stopper 110 is provided with at least one keying groove 116 on an outer circumference thereof in a lengthwise direction thereof to face the cutout slot 115 in a diametrical direction.

Here, the cutout slots 115 may be selectively formed at intervals of 45, 90, 120, or 180 degrees, preferably 120 degrees.

Thus, the keying groove 116 may be formed in the middle of each inner sub-stopper, into which the inner stopper 110 is divided by the cutout slots 115.

In order to prevent separation between the inner sub-stoppers into which the inner stopper 110 is divided by the cutout slots 115, at least one ring retaining groove 114 is formed in at least one of upper and lower outer circumferences of the inner stopper 110. A snap ring 140 is fitted into the ring retaining groove 114.

Here, the ring retaining groove 114 may be formed in each of the upper and lower outer circumferences of the inner stopper 110. This is because, if the snap ring 140 is fitted into the ring retaining groove 114 at one side alone, the inner sub-stoppers of the inner stopper 110 may move to be separated from each other at the other side where the snap ring 140 is not fitted.

Further, in addition to the function of preventing the separation between the inner sub-stoppers of the inner stopper 110, the snap ring 140 serves to transmit a predetermined resilient force to the pressure ridges 112 when the second pipe 20 moves upward to allow the second pipe 20 to move upward, so that the pressure ridges 112 press the outer circumference of the second pipe 20 by the resilient force, thereby regulating downward movement of the second pipe 20.

In addition, the snap ring 140 is partially cut out.

The outer stopper 120 is provided with a support wall 121 on an upper inner circumference thereof such that the inner stopper 110 is inserted and supported. The upper inner circumference of the outer stopper 120 has an average inner diameter equal or similar to the average outer diameter of an inclined surface 111 of the inner stopper 110.

Further, the outer stopper 120 is provided with a stop step 127 on the inner circumference thereof under the support wall 121. The stop step 127 is formed so that one end of the first pipe 10 inserted into the outer stopper 120 is caught.

The lower portion of the outer stopper 120 into which the first pipe 10 is inserted has an inner diameter equal or similar to an outer diameter of the first pipe 10.

The stop step 127 has an inner diameter equal or similar to the inner diameter of the first pipe 10 and greater than the outer diameter of the second pipe 20. This is because the second pipe 20 is inserted into the first pipe 10 through the stop step 127.

Further, in order to more effectively press and fix the outer circumference of the second pipe 20, the outer diameter of the inclined surface 111 of the inner stopper 110 and the inner diameter of the support wall 121 of the outer stopper 120 may be formed to be gradually reduced in the inserting direction of the inner stopper 110 at a predetermined angle of inclination.

This is because, when the inner stopper 110 moves along the inclined support wall 121 due to the load that is transmitted from the outside (i.e. the slab) to the inner stopper 110 through the second pipe 20, the inner stopper 110 is subjected to reduction in diameter, i.e. is contracted in an inward direction, thereby making it possible to more effectively press and fix the outer circumference of the second pipe 20.

Further, the support wall 121 is provided with at least one keying groove 126 at a position that corresponds to the keying groove 116 formed in the inclined surface 111 of the inner stopper 110.

At this time, the keying groove 116 of the inner stopper 110 is aligned with the keying groove 126 of the outer stopper 120, and then an anti-rotation key 150 is inserted into the aligned keying grooves 116 and 126. As a result, the inner stopper 110 is prevented from rotating in the outer stopper 120.

Here, the anti-rotation key 150 may be fixed by a fastening member, which is inserted into a through-hole bored through the outer stopper 120 to pass through the keying groove 126.

Further, the anti-rotation key 150 may be integrally formed with the inner circumference of the outer stopper 120.

In addition, the outer cap 130 is coupled with an upper end or an upper end surface of the outer stopper 120 such that the inner stopper 110 placed in the outer stopper 120 does not escape from the outer stopper 120 to the outside.

At this time, the outer cap 130 is coupled with the outer stopper 120 by fastening members such as screws or by threads. In the latter case, the outer cap 30 is provided with a second threaded part 137 on an inner circumference thereof, and the outer stopper 120 is provided with a first threaded part 128 on an outer circumference of the upper end thereof.

Alternatively, the outer cap 130 may be provided with a hook step to be hooked on the outer circumference of the upper end of the outer stopper 120.

As described above, the construction support has the following effects.

First, when a second pipe is precisely adjusted to be in contact with a foam for a slab, and then an inner stopper coupled to the second pipe moves to be coupled inside an outer stopper, pressure ridges formed on the inner stopper press and fix an outer circumference of the second pipe, so that the second pipe is positioned and fixed to the foam for the slab in a more precise manner. Thus, the construction support can more effectively provide a supporting force to the slab.

Second, the pressure ridges of the inner stopper are formed in the form of a ratchet, and press and fix the outer circumference of the second pipe, so that the second pipe to which the load transmitted from the slab is applied is not easily moved in the direction in which the load is applied. Thus, the construction support can provide a firm supporting force to the slab and prevent accidents.

Third, an outer cap coupled to the outer circumference of the outer stopper is turned, thereby pressing the inner stopper in an inserting direction. Otherwise, the outer cap is turned in the opposite direction, thereby pressing a separation guide flange to easily separate the inner stopper from the outer stopper. Thus, installation and dismantlement of the construction support can be performed in a more convenient manner to contribute to reduction of personnel expenses.

While the invention has been shown and described with reference to certain example embodiments thereof, it will be understood by those skilled in the art that various changes in form and details may be made therein without departing from the spirit and scope of the invention as defined by the appended claims.

What is claimed is:

1. A length-adjustable construction support, comprising:

a first pipe;

a second pipe having an outer diameter smaller than an inner diameter of the first pipe;

an inner stopper coupled to an outer circumference of the second pipe at a set position, the inner stopper includes a plurality of pressure ridges formed on an inner circumference thereof to press and fix the outer circumference of the second pipe, a separation guide flange protruding outward from an outer circumference thereof by a set length, at least one cutout slot formed in a lengthwise direction thereof, and at least one ring retaining groove formed in at least one of upper and lower ends thereof, and the at least one ring retaining groove is fitted with a snap ring; and an outer stopper having a support wall formed on an inner circumference thereof such that the inner stopper is inserted and supported, and a stop step formed at a lower end of the support wall to be supported on the first pipe.

2. The support of claim 1, wherein the inner stopper includes an inclined surface on an outer circumference thereof such that an outer diameter thereof is gradually reduced in an inserting direction thereof, and the support wall of the outer stopper is inclined corresponding to the inclined surface of the inner stopper.

3. The support of claim 1, wherein the pressure ridges are formed in the form of a sawtooth or ratchet.

4. The support of claim 3, wherein the sawtooth or ratchet form is inclined in a direction opposite to an inserting direction of the inner stopper.

5. The support of claim 1, further comprising an outer cap having an inner circumference of which a diameter is equal to a diameter of an upper outer circumference of the outer stopper to be coupled to the upper outer circumference of the outer stopper, and which has a through-hole in the center thereof to allow the inner stopper inserted into the outer stopper to be inserted.

6. The support of claim 5, wherein the outer cap includes a threaded part formed on the inner circumference thereof, and the outer stopper includes a first threaded part formed on the upper outer circumference thereof, so that the outer cap is screwed with the outer stopper.

7. The support of claim 5, wherein the outer cap includes at least one rotating handle formed on the outer circumference thereof at intervals of a set angle.

8. The support of claim 5, wherein the through-hole has a diameter smaller than an outer diameter of the separate guide flange.

9. The support of claim 1, wherein the outer stopper includes at least one keying groove formed in the inner circumference thereof, and the inner stopper includes at least one keying groove formed in the outer circumference thereof to correspond to the keying groove of the outer stopper, the keying grooves being fitted with an anti-rotation key to prevent the inner stopper from rotating.

10. The support of claim 9, wherein the anti-rotation key is integrally formed with the keying groove of the outer stopper.

11. The support of claim 5, wherein the inner stopper includes a retaining recess that is recessed inward under the separation guide flange with a predetermined width, so that the through-hole of the outer cap is located in the retaining recess to allow the outer cap to move in the retaining recess within the predetermined width.

12. The support of claim 1, further comprising:

a third threaded part formed on a lower outer circumference of the outer stopper;

a precise adjustor having a fourth threaded part formed on an inner circumference thereof to be screwed with the third threaded part, a fifth threaded part formed below the fourth threaded part, and an adjusting knob formed on an outer circumference thereof; and a coupler having a sixth threaded part formed on an outer circumference thereof to be screwed with the fifth threaded part, and coupled to the outer circumference of the first pipe.

13. A length-adjustable construction support, comprising:

a first pipe;

a second pipe having an outer diameter smaller than an inner diameter of the first pipe;

an inner stopper coupled to an outer circumference of the second pipe at a set position, the inner stopper includes a plurality of pressure ridges formed on an inner circumference thereof to press and fix the outer circumference of the second pipe, a separation guide flange protruding outward from an outer circumference thereof by a set length, and at least one cutout slot formed in a lengthwise direction thereof; and an outer stopper having a support wall formed on an inner circumference thereof such that the inner stopper is inserted and supported, and a stop step formed at a lower end of the support wall to be supported on the first pipe, wherein the pressure ridges are formed in the form of a sawtooth or ratchet, the sawtooth or ratchet form is inclined in a direction opposite to an inserting direction of the inner stopper.

14. A length-adjustable construction support, comprising:

a first pipe;

a second pipe having an outer diameter smaller than an inner diameter of the first pipe;

an inner stopper coupled to an outer circumference of the second pipe at a set position, the inner stopper includes a plurality of pressure ridges formed on an inner circumference thereof to press and fix the outer circumference of the second pipe, a separation guide flange protruding outward from an outer circumference thereof by a set length, and at least one cutout slot formed in a lengthwise direction thereof;

an outer stopper having a support wall formed on an inner circumference thereof such that the inner stopper is inserted and supported, and a stop step formed at a lower end of the support wall to be supported on the first pipe; and an outer cap having an inner circumference of which a diameter is equal to a diameter of an upper outer circumference of the outer stopper to be coupled to the upper outer circumference of the outer stopper, and which has a through-hole in the center thereof to allow the inner stopper inserted into the outer stopper to be inserted, wherein the outer cap includes a threaded part formed on the inner circumference thereof, and the outer stopper includes a first threaded part formed on the upper outer circumference thereof, so that the outer cap is screwed with the outer stopper.

15. The support of claim 14, wherein the outer cap includes at least one rotating handle formed on the outer circumference thereof at intervals of a set angle.

16. The support of claim 14, wherein the through-hole has a diameter smaller than an outer diameter of the separate guide flange.

17. A length-adjustable construction support, comprising:

a first pipe;

a second pipe having an outer diameter smaller than an inner diameter of the first pipe;

an inner stopper coupled to an outer circumference of the second pipe at a set position, the inner stopper includes a plurality of pressure ridges formed on an inner circumference thereof to press and fix the outer circumference of the second pipe, a separation guide flange protruding outward from an outer circumference thereof by a set length, and at least one cutout slot formed in a lengthwise direction thereof; and an outer stopper having a support wall formed on an inner circumference thereof such that the inner stopper is inserted and supported, a stop step formed at a lower end of the support wall to be supported on the first pipe, and at least one keying groove formed in the inner circumference thereof, wherein the inner stopper includes at least one keying groove formed in the outer circumference thereof to correspond to the keying groove of the outer stopper, the keying grooves are fitted with an anti-rotation key to prevent the inner stopper from rotating.

18. The support of claim 17, wherein the anti-rotation key is integrally formed with the keying groove of the outer stopper.

19. A length-adjustable construction support, comprising:

a first pipe;

a second pipe having an outer diameter smaller than an inner diameter of the first pipe;

an inner stopper coupled to an outer circumference of the second pipe at a set position, the inner stopper includes a plurality of pressure ridges formed on an inner circumference thereof to press and fix the outer circumference of the second pipe, a separation guide flange protruding outward from an outer circumference thereof by a set length, and at least one cutout slot formed in a lengthwise direction thereof;

an outer stopper having a support wall formed on an inner circumference thereof such that the inner stopper is inserted and supported, and a stop step formed at a lower end of the support wall to be supported on the first pipe;

a third threaded part formed on a lower outer circumference of the outer stopper;

a precise adjustor having a fourth threaded part formed on an inner circumference thereof to be screwed with the third threaded part, a fifth threaded part formed below the fourth threaded part, and an adjusting knob formed on an outer circumference thereof; and a coupler having a sixth threaded part formed on an outer circumference thereof to be screwed with the fifth threaded part, and coupled to the outer circumference of the first pipe.

* * * * *